United States Patent [19]

Breidenbach

[11] 4,154,419

[45] May 15, 1979

[54] SHELF SUPPORT BRACKET CONSTRUCTION

[75] Inventor: James H. Breidenbach, Sturgis, Mich.

[73] Assignee: Harter Corporation, Sturgis, Mich.

[21] Appl. No.: 912,477

[22] Filed: Jun. 5, 1978

[51] Int. Cl.[2] ..... A47B 29/02

[52] U.S. Cl. ..... 248/243; 108/110; 211/187; 211/192

[58] Field of Search ..... 248/243; 108/108, 109, 108/110, 107, 111, 114; 211/187, 191, 192; 52/36

[56] References Cited

U.S. PATENT DOCUMENTS

| | | | |
|---|---|---|---|
| 1,336,971 | 4/1920 | Levene | 248/343 X |
| 3,422,962 | 1/1969 | Burns et al. | 211/191 |
| 3,895,774 | 7/1975 | Sharp | 108/108 X |
| 4,048,768 | 9/1977 | Good | 248/243 X |

FOREIGN PATENT DOCUMENTS

| | | | |
|---|---|---|---|
| 218493 | 8/1958 | Australia | 108/109 |
| 1179678 | 10/1964 | Fed. Rep. of Germany | 248/243 |

*Primary Examiner*—J. Franklin Foss
*Attorney, Agent, or Firm*—Hamilton, Renner & Kenner

[57] ABSTRACT

A shelf support bracket construction adapted for use singly or in pairs for engaging into a vertical wall divider or spline and having at least one rearwardly disposed projection and at least one forwardly disposed laterally offset projection for supporting an appurtenance. When used in pairs the brackets intermesh and the rearward projections of the brackets are vertically offset with respect to each other to engage in adjacent slots in the spline with the forward projections in horizontal alignment.

7 Claims, 4 Drawing Figures

Figure 1:
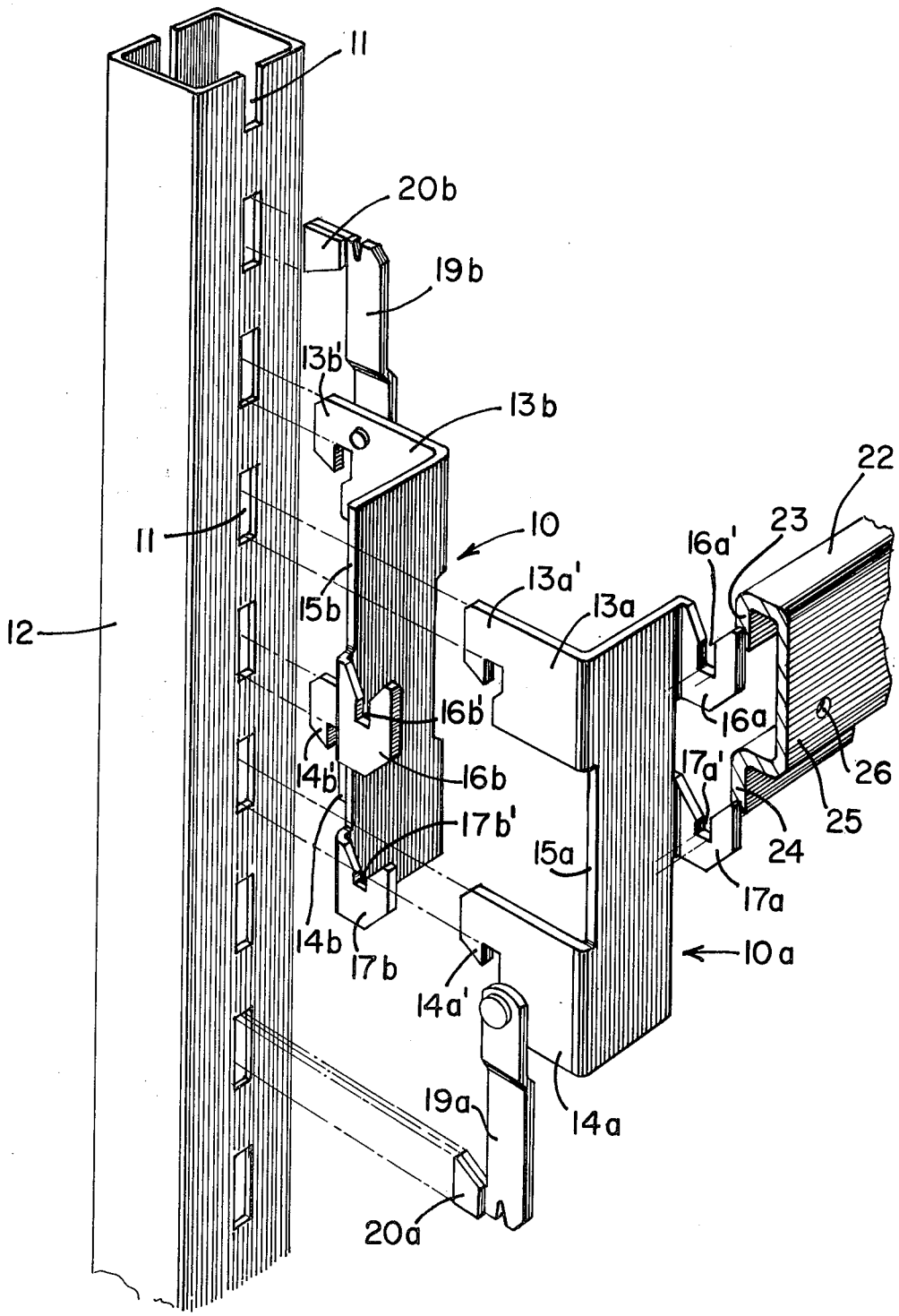
Figure 2:
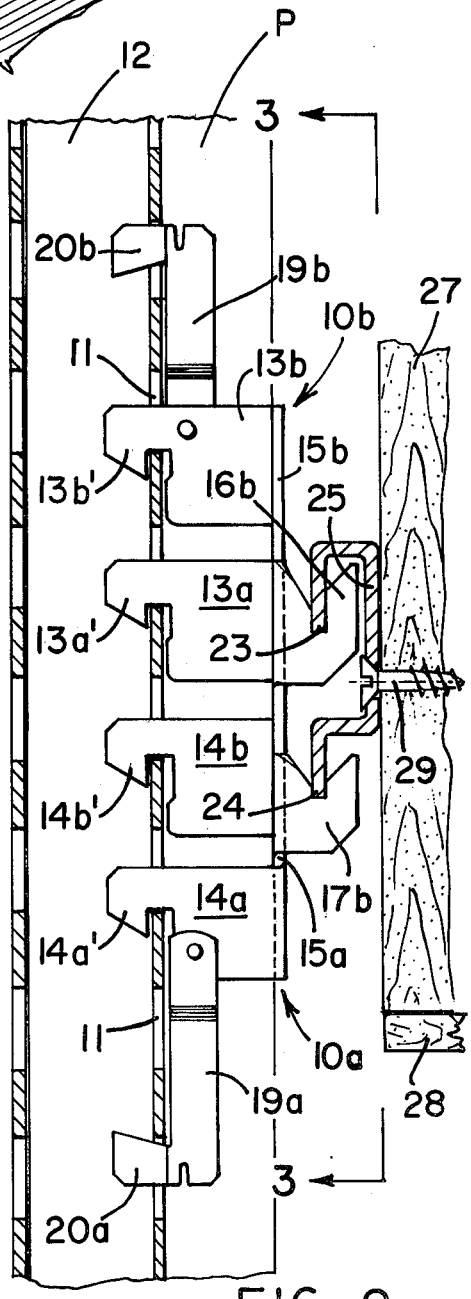
Figure 3:
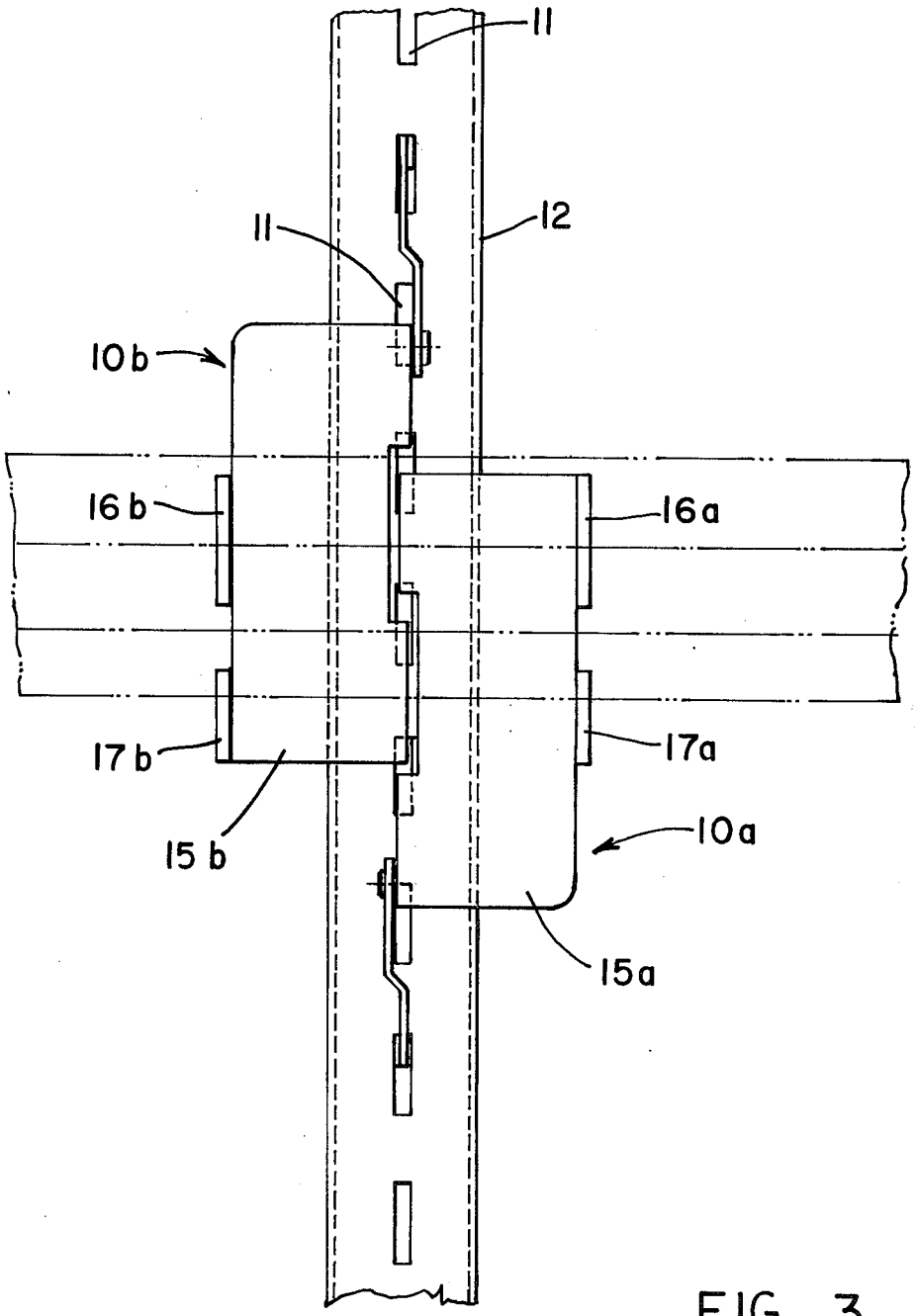

SHELF SUPPORT BRACKET CONSTRUCTION be used to support a shelf-supporting bar which extends on both sides of the spline at a panel joint as in FIGS. 1-3, or to support the ends of two shelf bars adjoining each other at the panel joint. The single right hand bracket in FIG. 4 supports the end of a shelf bar extending to the right, and in order to support the end of a shelf bar extending to the left, a left hand bracket may be intermeshed with the right bracket shown and engaged in different slots in the same spline.

Referring to FIGS. 1 and 2, the right hand bracket is indicated generally at 10*a* and the left hand bracket at 10*b*. Each of the brackets has rearwardly extending flanges terminating in downturned hooks for engaging in slots 11 in a vertical spline 12. Bracket 10*a* has rearwardly extending flanges 13*a* and 14*a* terminating in hooks 13*a'* and 14*a'*, and bracket 10*b* has rearwardly extending flanges 13*b* and 14*b* terminating in hooks 13*b'* and 14*b'*. The hooks form downwardly open notches which are preferably spaced apart so as to engage over the lower edges of two spline slots 11 with one slot in between, or in other words, in the first and third slots of a group of three slots, for a purpose to be described.

Each of the brackets has a front flange extending laterally from the forward edges of the laterally extending flanges and in front of the wall panels P. The front flange 15*a* extends laterally to the right from flanges 13*a* and 14*a* and the front flange 15*b* extends laterally to the left from flanges 13*b* and 14*b*. Each of the front flanges 15*a* and 15*b* has forwardly extending shelf-supporting projections at its laterally outward edges. The flange 15*a* preferably has upper and lower projections 16*a* and 17*a* and the flange 15*b* preferably has upper and lower projections 16*b* and 17*b*. These projections preferably have upwardly open vertical notches 16*a'* and 17*a'*, and 16*b'* and 17*b'*, respectively.

It is to be noted that the projection 16*a* extends downward from the upper edge of flange 15*a*, whereas the projection 16*b* is vertically offset or spaced below the upper edge of flange 15*b*. Similarly, the projection 17*b* extends upwardly from the lower edge of flange 15*b*, whereas the projection 17*a* is vertically offset or spaced above the upper edge of flange 15*a*. These offset spacings are calculated so that when the two brackets 10*a* and 10*b* are vertically offset and intermeshed as in FIGS. 2 and 3, the projections 16*a* and 16*b* and their notches 16*a'* and 16*b'* will be horizontally aligned, and the projections 17*a* and 17*b* and their notches 17*a'* and 17*b'* will be horizontally aligned.

As shown in FIGS. 2 and 3, when the brackets 10*a* and 10*b* are intermeshed, the upper rearward flange 13*a* is positioned between rearward flanges 13*b* and 14*b*, with the hook 13*a'* engaging in a slot 11 between and vertically adjacent to the slots engaged by hooks 13*b'* and 14*b'*. Similarly, the lower rearward flange 14*b* is positioned between rearward flanges 13*a* and 14*a*, with the hook 14*b'* engaging in a slot 11 between and vertically adjacent to the slots engaged by hooks 13*a'* and 14*a'*.

Preferably, the brackets 10*a* and 10*b* are provided with locking means such as shown in prior U.S. Pat. No. 4,048,768. Thus, a locking arm 19*a* may be pivoted at 20*a* on flange 14*a* and a locking arm 19*b* may be pivoted at 20*b* on flange 13*b*. The lower end of arm 19*a* has an angular rearwardly projecting tab 20*a* thereon for engaging in the second slot below the slot engaged by hook 14*a'*, and the upper end of arm 19*b* has an angular rearwardly extending tab 20*b* thereon for engaging in the next adjacent slot above the slot engaged by hook 13*b'*. Obviously, when the tab 20*a* is engaged in its slot 11 it prevents upward movement of the bracket 10*a* sufficient to disengage the hooks 13*a'* and 14*a'* from their slots, and when tab 20*b* is engaged in its slot 11 it prevents upward movement of bracket 10*b* sufficient to disengage the hooks 13*b'* and 14*b'* from their slots.

The projections 16*a*, 16*b* and 17*a*, 17*b* are adapted to support a horizontal self-supporting bar 22 in front of the wall panels P and having a downturned rear flange 23 along its upper edge and a downwardly extending flange 24 extending along its lower edge. The flange 23 is adapted to engage in notchs 16*a'* and 16*b'* and the flange 24 in notches 17*a'* and 17*b'* when the brackets 10*a* and 10*b* are intermeshed and engaged in the spline slots, as indicated in FIG. 2. The front wall 25 of the bar preferably has a series of screw holes 26 therein for attaching the vertical wall 27 of a shelf 28 or a like appurtenance by means of screws 29.

In operation the brackets 10*a* and 10*b* may be engaged in the spline slots in the intermeshed position of FIGS. 2 and 3, and their locking arms 19*a* and 19*b* then swung to engage the tabs 20*a* and 20*b* in the corresponding spline slots 11. The shelf-supporting bar is then engaged in the notches 16*a*, 16*b* and 17*a*, 17*b*.

Figure 4:
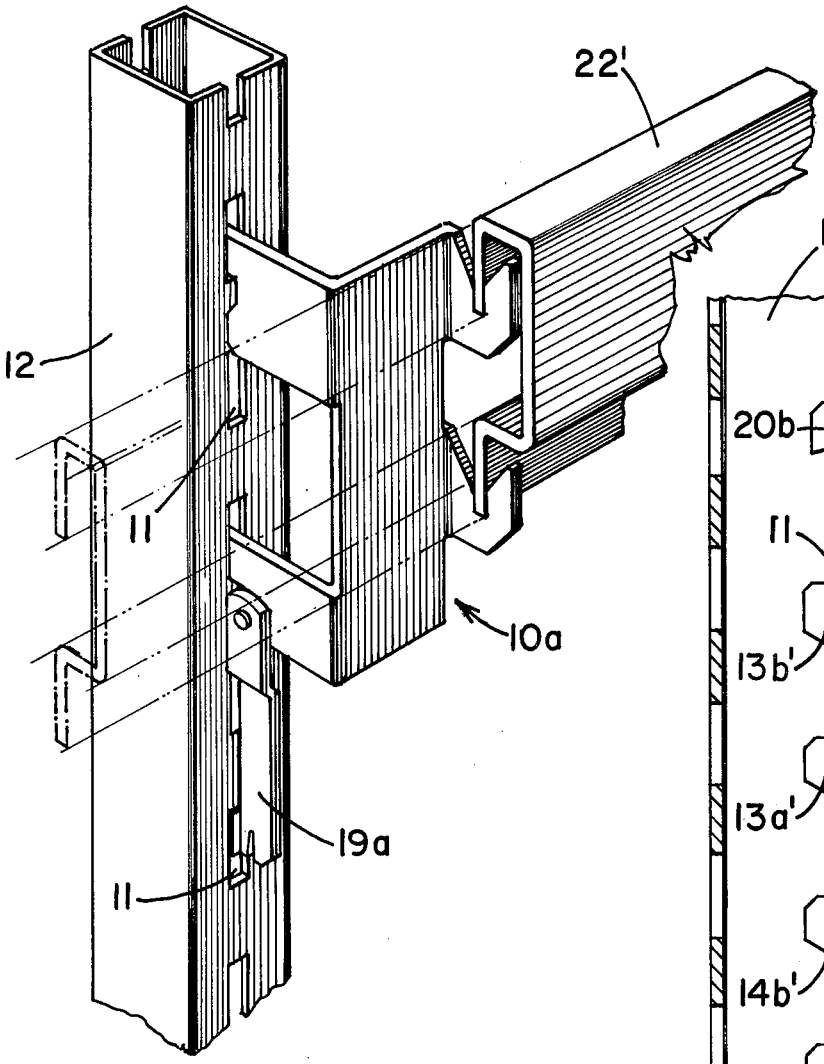

Referring to FIG. 4, if the shelf-supporting bar ends at the spline 12, only one of the brackets is needed, as indicated by bracket 10*a*, to support the end portion of the bar. It will be apparent that should it be desired to support the end portion of another bar extending in the opposite direction, a left hand bracket 10*b* can be intermeshed with bracket 10*a* to support the end of the other bar, without disengaging the bracket 10*a*. Thus the shelf supported by bar 22' can be in effect extended or continued without having to remove the original shelf and its contents.

The novel and improved bracket construction is adapted to be used singly or in pairs for various shelf-supporting arrangements and requires no additional parts. It is quickly and easily installed or removed without the aid of tools.

What is claimed is:

1. A shelf support for use with a wall spline having a series of vertically spaced slots therein, comprising a bracket having two vertically spaced rearwardly extending flanges terminating in hooks for engaging in two of said slots with at least one slot therebetween, a front flange extending laterally from said rearwardly extending flanges having at least one forwardly extending shelf-supporting projection at its outer edge, the rearwardly extending flanges being spaced apart to allow a rearwardly extending hook of an intermeshing similar bracket to engage in the intermediate slot, said similar bracket having its front flange extending laterally from said rearwardly extending flanges in a direction opposite to that of said first front flange.

2. A shelf support as described in claim 1, wherein said similar bracket has at least one forwardly extending shelf-supporting projection in horizontal alignment with said shelf-supporting projection of said first bracket when the two brackets are intermeshed.

3. A shelf support as described in claim 1, wherein locking means is movably mounted on one of said rearwardly extending flanges for detachably engaging in another slot of said spline to prevent disengagement of said hooks from said spline.

4. A shelf support for use with a wall spline having a series of vertically spaced slots therein, comprising a pair of opposite hand brackets each having at least one rearwardly extending flange terminating in a hook for engaging in a slot in said spline and a front flange extending laterally from said rearwardly extending flange, said front flanges extending in laterally opposite directions and having at least one forwardly extending shelf-supporting projection at their laterally outer edges, said shelf-supporting projections being positioned relative to said rearwardly extending flanges so as to be in horizontal alignment with the rearwardly disposed hooks are engaged in vertically adjacent slots in said spline.

5. A shelf support as described in claim 4, wherein locking means is movably mounted on each rearwardly extending flange for detachably engaging other slots of said spline to prevent disengagement of said hooks from said spline.

6. A shelf support as described in claim 4, wherein each bracket has a pair of vertically spaced rearwardly extending flanges terminating in hooks engageable in alternating slots in said spline when the shelf-supporting projections are in horizontal alignment.

7. A shelf support as described in claim 6, wherein locking means is movably mounted on each bracket for detachably engaging other slots of said spline to prevent disengagement of said hooks from said spline.

* * * * *

UNITED STATES PATENT AND TRADEMARK OFFICE

CERTIFICATE OF CORRECTION

PATENT NO. : 4,154,419

DATED : May 15, 1979

INVENTOR(S) : James H. Breidenbach

It is certified that error appears in the above—identified patent and that said Letters Patent is hereby corrected as shown below:

Columns 1 thru 4 should be deleted to insert the attached columns 1 thru 4 respectively therefor.

Signed and Sealed this

*Nineteenth* Day of *August 1980*

[SEAL]

*Attest:*

SIDNEY A. DIAMOND

*Attesting Officer*

*Commissioner of Patents and Trademarks*